US009725673B2

(12) United States Patent
Griffin et al.

(10) Patent No.: US 9,725,673 B2
(45) Date of Patent: Aug. 8, 2017

(54) LUBRICANT COMPOSITIONS FOR IMPROVED ENGINE PERFORMANCE

(75) Inventors: Paul G. Griffin, Glen Allen, VA (US); Jeremy P. Styer, Richmond, VA (US)

(73) Assignee: AFTON CHEMICAL CORPORATION, Richmond, VA (US)

( * ) Notice: Subject to any disclaimer, the term of this patent is extended or adjusted under 35 U.S.C. 154(b) by 42 days.

(21) Appl. No.: 12/731,462

(22) Filed: Mar. 25, 2010

(65) Prior Publication Data

US 2011/0237476 A1 Sep. 29, 2011

(51) Int. Cl.
*C10M 169/04* (2006.01)
*C10M 137/06* (2006.01)
*C10M 137/10* (2006.01)

(52) U.S. Cl.
CPC ..... *C10M 169/045* (2013.01); *C10M 137/06* (2013.01); *C10M 137/10* (2013.01); *C10M 169/04* (2013.01); *C10M 2201/085* (2013.01); *C10M 2207/028* (2013.01); *C10M 2223/042* (2013.01); *C10M 2223/045* (2013.01); *C10N 2230/02* (2013.01); *C10N 2230/04* (2013.01); *C10N 2230/06* (2013.01); *C10N 2230/52* (2013.01); *C10N 2230/54* (2013.01); *C10N 2240/10* (2013.01)

(58) Field of Classification Search
USPC ..... 508/423, 435
See application file for complete search history.

(56) References Cited

U.S. PATENT DOCUMENTS

| | | | |
|---|---|---|---|
| 2,001,108 | A | 5/1935 | Parker |
| 2,081,075 | A | 5/1937 | Vobach |
| 2,095,538 | A | 10/1937 | Vobach |
| 2,144,078 | A | 1/1939 | Neely |
| 2,163,622 | A | 6/1939 | Neely et al. |
| 2,270,183 | A | 1/1942 | William et al. |
| 2,292,205 | A | 8/1942 | Denison, Jr. et al. |
| 2,335,017 | A | 11/1943 | McNab et al. |
| 2,399,877 | A | 5/1946 | McNab et al. |
| 2,416,281 | A | 2/1947 | Berger et al. |
| 2,451,345 | A | 10/1948 | McNab et al. |
| 2,451,346 | A | 10/1948 | McNab et al. |
| 2,485,861 | A | 10/1949 | Campbell et al. |
| 2,501,731 | A | 3/1950 | Mertes |
| 2,501,732 | A | 3/1950 | Mertes |
| 2,585,520 | A | 2/1952 | Ess et al. |
| 2,616,904 | A | 11/1952 | Asseff et al. |
| 2,616,905 | A | 11/1952 | Asseff et al. |
| 2,616,906 | A | 11/1952 | Asseff et al. |
| 2,616,911 | A | 11/1952 | Asseff et al. |
| 2,616,924 | A | 11/1952 | Asseff et al. |
| 2,616,925 | A | 11/1952 | Asseff et al. |
| 2,617,049 | A | 11/1952 | Asseff et al. |
| 2,671,758 | A | 3/1954 | Rubin et al. |
| 2,695,910 | A | 11/1954 | Asseff et al. |
| 3,178,368 | A | 4/1965 | Hanneman |
| 3,219,666 | A | 11/1965 | Norman et al. |
| 3,259,580 | A | 7/1966 | Petersen et al. |
| 3,367,867 | A | 2/1968 | Abbott et al. |
| 3,496,105 | A | 2/1970 | LeSuer |
| 3,565,804 | A | 2/1971 | Honnen et al. |
| 3,629,109 | A | 12/1971 | Gergel et al. |
| 3,697,574 | A | 10/1972 | Piasek et al. |
| 3,736,357 | A | 5/1973 | Piasek et al. |
| 3,865,737 | A | 2/1975 | Kemp |
| 3,907,691 | A | 9/1975 | King et al. |
| 4,100,085 | A | 7/1978 | Peditto et al. |
| 4,129,589 | A | 12/1978 | Eliades et al. |
| 4,137,184 | A | 1/1979 | Bakker |
| 4,212,752 | A | 7/1980 | Fossati et al. |
| 4,234,435 | A | 11/1980 | Meinhardt et al. |
| 4,259,194 | A | 3/1981 | DeVries et al. |
| 4,259,195 | A | 3/1981 | King et al. |
| 4,261,843 | A | 4/1981 | King et al. |
| 4,263,152 | A | 4/1981 | King et al. |
| 4,265,773 | A | 5/1981 | DeVries et al. |
| 4,272,387 | A | 6/1981 | King et al. |
| 4,283,295 | A | 8/1981 | DeVries et al. |
| 4,285,822 | A | 8/1981 | DeVries et al. |
| 4,617,135 | A | 10/1986 | Muir |
| 4,636,322 | A | 1/1987 | Nalesnik |
| 4,647,387 | A | 3/1987 | Muir |
| 4,702,850 | A | 10/1987 | Gutierrez et al. |
| 4,867,890 | A | 9/1989 | Colclough et al. |
| 4,880,550 | A | 11/1989 | Hunt |
| 4,943,672 | A | 7/1990 | Hamner et al. |
| 5,627,259 | A | 5/1997 | Thaler et al. |
| 5,633,326 | A | 5/1997 | Patil et al. |
| 5,643,859 | A | 7/1997 | Gutierrez et al. |
| 5,726,132 | A | 3/1998 | Roby et al. |
| 5,728,656 | A * | 3/1998 | Yamaguchi et al. ..... 508/371 |
| 5,792,729 | A | 8/1998 | Harrison et al. |
| 5,851,965 | A | 12/1998 | Harrison et al. |
| 5,853,434 | A | 12/1998 | Harrison et al. |
| 5,882,505 | A | 3/1999 | Wittenbrink et al. |
| 5,936,041 | A | 8/1999 | Diana et al. |
| 6,008,166 | A | 12/1999 | Cook et al. |
| 6,013,171 | A | 1/2000 | Cook et al. |
| 6,080,301 | A | 6/2000 | Berlowitz et al. |
| 6,096,940 | A | 8/2000 | Wittenbrink et al. |
| 6,103,099 | A | 8/2000 | Wittenbrink et al. |
| 6,165,949 | A | 12/2000 | Berlowitz et al. |

(Continued)

FOREIGN PATENT DOCUMENTS

JP 2003155492 A 5/2003

*Primary Examiner* — Taiwo Oladapo
(74) *Attorney, Agent, or Firm* — Luedeka Neely Group, PC

(57) ABSTRACT

The disclosure provides a lubricant composition for lubricating an engine, a method for operating an engine and an additive concentrate. The lubricant composition includes a base oil of lubricating viscosity; one or more metal dialkyldithiophosphates having more than 75 mole percent of alkyl groups derived from 4-methyl-2-pentanol, and from about 0.1 to about 2.0 percent by weight of detergent derived from an alkyl phenol or sulfurized alkyl phenol based on a total weight of the lubricant composition. An amount of the one or more metal dialkyldithiophosphate in the lubricant composition ranges from about 0.01 to about 0.10 percent by weight phosphorus based on a total weight of the lubricant composition. The lubricant composition has a total a total base number (TBN) of about 5.0 to about 10.0.

12 Claims, No Drawings

(56) References Cited

U.S. PATENT DOCUMENTS

| | | | | |
|---|---|---|---|---|
| 6,180,575 | B1 | 1/2001 | Nipe | |
| 6,723,685 | B2 | 4/2004 | Hartley et al. | |
| 6,846,782 | B2 * | 1/2005 | Calder | 508/293 |
| 6,869,919 | B2 * | 3/2005 | Ritchie et al. | 508/221 |
| 7,368,596 | B2 | 5/2008 | Thomson et al. | |
| 7,772,171 | B2 | 8/2010 | Al-Ahmad et al. | |
| 2002/0038525 | A1 | 4/2002 | Callis et al. | |
| 2003/0134754 | A1 * | 7/2003 | Kelley | 508/287 |
| 2004/0266630 | A1 | 12/2004 | George et al. | |
| 2005/0166868 | A1 | 8/2005 | Wilk et al. | |
| 2008/0206874 | A1 * | 8/2008 | Manka | 436/2 |

* cited by examiner

LUBRICANT COMPOSITIONS FOR IMPROVED ENGINE PERFORMANCE

TECHNICAL FIELD

The disclosure is directed to engine lubricant compositions and more specifically to lubricant compositions that provide improved engine deposit control for improved engine performance.

BACKGROUND AND SUMMARY

Engine lubricant formulations are specifically designed for addressing a wide range of performance characteristics. The ability of a lubricant composition to meet specific performance characteristics may vary considerably depending on the base oil used to formulate the lubricant composition. For example, a lubricant composition that includes an additive package in a Group II base oil may pass a specific engine test. However, the same additive package in a Group I base oil may fail the engine test. Ideally, if an additive package is designed to pass an engine test with the lowest grade base oil, e.g., a Group I base oil, then it is likely that the same additive package will pass the engine test with higher grade base oils, e.g., Group II, III, or IV base oils.

One engine test that provides an indication of the performance of an additive package in a base oil is the sequence IIIG engine test. In the sequence IIIG engine test, in order to meet the requirements of the latest North American engine oil specification, ILSAC GF-5, a lubricant composition must exhibit a 40° C. viscosity increase of no more than 150%, have a weighted piston deposit rating of greater than 3.5, have an average cam-plus-lifter wear of less than 60 μm, have no stuck piston rings, and have a hot oil consumption of less than 4.65 liters. The ability of a lubricant to meet all of these requirements is determined by both the base oil and the additive package. Hence, there continues to be a need for additive compositions for lubricants that provide improved engine performance in a wider variety of base oils without significantly increasing the cost of the additive package or the amount of ingredients used in the additive package.

With regard to the above, the disclosure provides a lubricant composition for lubricating an engine. The lubricant composition includes a base oil of lubricating viscosity, one or more metal dialkyldithiophosphates having more than 75 mole percent of alkyl groups derived from 4-methyl-2-pentanol, and from about 0.1 to about 2.0 percent by weight of detergent derived from an alkyl phenol or sulfurized alkyl phenol based on a total weight of the lubricant composition. An amount of the one or more metal dialkyldithiophosphates in the lubricant composition ranges from about 0.01 to about 0.10 percent by weight phosphorus based on a total weight of the lubricant composition. The lubricant composition has a total a total base number (TBN) of about 5.0 to about 10.0.

In another embodiment, the disclosure provides a method for reducing engine deposits. The method includes formulating a lubricant composition to contain a base oil of lubricating viscosity and an effective amount of synergistic additive and operating an engine on the lubricant composition. The synergistic additive includes (i) one or more metal dialkyldithiophosphates having more than 75 mole percent of alkyl groups derived from 4-methyl-2-pentanol, and (ii) from about 0.1 to about 2 weight percent of detergent derived from an alkyl phenol or sulfurized alkyl phenol, based on a total weight of the lubricant composition. The lubricant composition has a total a total base number (TBN) of about 5.0 to about 10.0.

Yet another embodiment of the disclosure provides a synergistic additive concentrate for a lubricating oil composition. The additive concentrate includes (i) one or more metal dialkyldithiophosphates having more than 75 mole percent of alkyl groups derived from 4-methyl-2-pentanol in an amount sufficient to provide 0.01 to about 0.1 percent by weight phosphorus to a fully formulated lubricant composition. Also included in the additive concentrate is (ii) a detergent derived from an alkyl phenol or sulfurized alkyl phenol, wherein a weight ratio of (i) to (ii) in the additive concentrate ranges from about 0.1:1 to about 12:1. The additive concentrate has a total base number (TBN) that is sufficient to provide a lubricant composition with a total a total base number (TBN) of about 5.0 to about 10.0.

Surprisingly and quite unexpectedly, the additive composition containing components (i) and (ii), described above, may be effective to provide a passing rating in a IIIG engine test for a Group II base oil. More specifically, the disclosed additive that includes component (i) may be surprisingly more effective in combination with a phenate detergent in a Group II base oil than one or more metal dialkyldithiophosphate having less than 75 mole percent alkyl groups derived from 4-methyl-2-pentanol. Likewise, the disclosed additive is surprisingly more effective in a Group II base oil than component (i) and other detergents in the absence of phenate detergents. Other features and advantages of the embodiments may be evident from the following detailed description.

DETAILED DESCRIPTION OF THE DISCLOSED EMBODIMENT(S)

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents such as pyridyl, furyl, thienyl, and imidazolyl. In general, no more than two, for example, no more than one, non-hydrocarbon substituent will be present for every ten carbon atoms in the hydrocarbyl group; typically, there will be no non-hydrocarbon substituents in the hydrocarbyl group.

As used herein, the term "percent by weight", unless expressly stated otherwise, means the percentage the recited component represents to the weight of the entire composition.

As used herein, the term "mole percent", unless expressly stated otherwise, means the percentage on a molar basis the recited component or composition represents to the total number of moles of the component or composition present.

The terms "oil-soluble" or "dispersable" used herein do not necessarily indicate that the compounds or additives are soluble, dissolvable, miscible, or capable of being suspended in the oil in all proportions. The foregoing terms do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

In accordance with embodiments of the disclosure, a synergistic additive composition is prepared that contains (i) one or more metal dialkyldithiophosphate having more than 75 mole percent of alkyl groups derived from 4-methyl-2-pentanol; and (ii) from about 0.1 to about 2.0 percent by weight, based on a total weight of a lubricant composition containing the additive of a detergent derived from an alkyl phenol or a sulfurized alkyl phenol.

Suitable metal dihydrocarbyl dithiophosphates may comprise dihydrocarbyl dithiophosphate metal salts wherein the metal may be an alkali or alkaline earth metal, or aluminum, lead, tin, molybdenum, manganese, nickel, copper, or zinc. In one embodiment, the one or more metal dihydrocarbyl dithiophosphate compounds may be a zinc dihydrocarbyl dithiophosphate compounds.

Dihydrocarbyl dithiophosphate metal salts may generally be prepared in accordance with known techniques by first forming a dihydrocarbyl dithiophosphoric acid (DDPA), usually by reaction of one or more alcohol or a phenol with $P_2S_5$ and then neutralizing the formed DDPA with a metal compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the metal salt, any basic or neutral metal compound could be used but the oxides, hydroxides and carbonates are most generally employed. Commercial additives frequently contain an excess of metal due to the use of an excess of the basic metal compound in the neutralization reaction.

The zinc dihydrocarbyl dithiophosphates (ZDDP) are oil soluble salts of dihydrocarbyl dithiophosphoric acids and may be represented by the following formula:

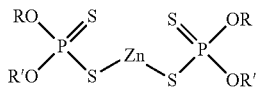

wherein R and R' may be the same or different hydrocarbyl radicals containing from 1 to 18, for example 2 to 12, carbon atoms and including radicals such as alkyl, alkenyl, aryl, arylalkyl, alkaryl, and cycloaliphatic radicals. R and R' groups may be alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e., R and R') in the dithiophosphoric acid will generally be about 5 or greater. In accordance with embodiments of the disclosure, at least about 75 mole percent of the alkyl groups of the one or more metal dialkyldithiophosphate components (i) is derived from 4-methyl-2-pentanol. In another embodiment, more than 80 mole percent of the alkyl groups of the one or more metal dialkyldithiophosphate components (i) is derived from 4-methyl-2-pentanol. In other embodiments, the amount of the one or more metal dialkyldithiophosphate components (i) that is derived from 4-methyl-2-pentanol may be more than 90 mole percent and desirably 100 mole percent. The metal dialkyldithiophosphates of component (i) may be made by a process such as the process generally described in U.S. Pat. No. 7,368,596.

Component (i) may be present in a lubricating composition in an amount sufficient to provide from about 100 to about 1000 ppm phosphorus. As a further example, component (i) may be present in a lubricating composition in an amount sufficient to provide from about 500 to about 800 ppm phosphorus.

Component (ii) of the additive is a detergent additive that is derived from an alkyl phenol or a sulfurized alkyl phenol. A detergent is an additive that is used to reduce the formation of piston deposits, for example high-temperature varnish and lacquer deposits, in engines. Detergents typically possess acid-neutralizing properties and are capable of keeping finely divided solids in suspension. Metal detergents may be used to improve the acid-neutralizing properties, high-temperature detergency, and anti-wear properties of the resulting lubricating oil composition.

Detergents may be of the ash-producing or ashless variety. Not all detergents are suitable for use in lubricating oils according to the disclosed embodiments. In order to obtain the synergistic results described herein, the detergent, or mixture of detergents desirably includes at least one alkali or alkaline earth metal detergent derived from an alkyl phenol. The alkyl phenols may contain one or more alkyl groups, each of which can have in the range of from 1 to 30, typically from 8 to 20 carbon atoms per alkyl radical. Also, the alkyl phenols may contain more than one ring structure, and more than one hydroxy group, although alkylated monohydroxy benzenes are more commonly used. The total number average molecular weight of the alkyl phenols that may be used is in the range of about 200 to about 700. The alkyl phenols may be synthesized by simple alkylation of phenol or naphthol with olefins. A suitable product may be prepared, for example, by alkylating phenol with polymeric materials obtained as by-products in the manufacture of butyl alcohol from petroleum refinery butenes. Such polymeric materials may contain normal butene, a small percentage of isobutene and other olefins, and give alkylated phenols having branched chain alkyl groups of 16 to 24 carbon atoms.

Alkali or alkaline earth metal salts of the alkyl phenols or sulfurized alkyl phenols may contain a substantially stoichiometric amount of the metal, in which case they are usually described as normal or neutral salts, and would typically have a total base number or TBN (as measured by ASTM D2896) of from about 0 to less than about 150. Large amounts of a metal base may be included by reacting an excess of a metal compound such as an oxide or hydroxide with an acidic gas such as carbon dioxide. The resulting overbased detergent comprises micelles of neutralized detergent surrounding a core of inorganic metal base (e.g., hydrated carbonates). Such overbased detergents may have a TBN of about 150 or greater, such as from about 150 to about 450 or more.

Suitable alkali or alkaline earth metals may be selected from sodium, potassium, lithium, calcium, and magnesium. More than one metal may be present, for example, both calcium and magnesium. Mixtures of calcium and/or magnesium with sodium may also be suitable. Suitable metal detergents for component (ii) may be neutral or overbased calcium or magnesium phenates or sulfurized phenates having a TBN of from 20 to 450 TBN.

The metal-containing detergent may be present in a lubricating composition in an amount of from about 0.01 wt % to about 5.0 wt %. In another example, the metal-containing detergent may be present in an amount of from about 0.05 to about 1.0 wt. %. As a further example, the metal-containing detergent may be present in an amount of from about 0.1 wt % to about 0.8 wt %. The metal-containing detergent may be present in a lubricating composition in an amount sufficient to provide from about 5 to about 2500 ppm alkali and/or alkaline earth metal to the lubricant composition based on a total weight of the lubricant composition. As a further example, the metal-containing detergent may be present in a lubricating composition in an amount sufficient to provide from about 100 to about 1000 ppm alkali and/or alkaline earth metal. Representative examples of suitable detergents for use in the additive compositions described herein may be found in U.S. Pat. No. 6,008,166, the disclosure of which is incorporated by reference herein.

Typically, the lubricant compositions for engine lubricant application has a total TBN ranging from about 5.0 to about 10.0, more typically from about 6.5 to about 8.0. Accordingly, if component (ii) has a TBN that is insufficient to provide the lubricant composition with a total TBN of from about 6.5 to about 8.0, then the lubricant composition may include one or more additional detergents. The additional detergents may be selected from alkali and alkaline earth metal sulfonates, phenates, salicylates and the like. When component (ii) has a relatively low TBN, then the additional detergent(s) will typically include at least one overbased detergent.

The term "overbased" in connection with metallic detergents may be used to designate metal salts wherein the metal is present in stoichiometrically larger amounts than the organic radical. The commonly employed methods for preparing the overbased salts involve heating a mineral oil solution of an acid with a stoichiometric excess of a metal neutralizing agent such as the metal oxide, hydroxide, carbonate, bicarbonate, or sulfide at a temperature of about 50° C., and filtering the resultant product. A particularly effective method for preparing the basic salts comprises mixing an acid with an excess of a basic alkaline earth metal neutralizing agent and at least one alcohol promoter, and carbonating the mixture at an elevated temperature such as 60° C. to 200° C.

Examples of suitable metal-containing detergents include, but are not limited to, neutral and overbased salts such as calcium or magnesium sulfonate, calcium or magnesium carboxylate, calcium or magnesium salicylate, calcium or magnesium phenate, and sulfurized calcium or magnesium phenate.

Methods for the production of calcium detergents are well known to those skilled in the art, and extensively reported in the patent literature. See, for example, U.S. Pat. Nos. 2,001,108; 2,081,075; 2,095,538; 2,144,078; 2,163,622; 2,270,183; 2,292,205; 2,335,017; 2,399,877; 2,416,281; 2,451,345; 2,451,346; 2,485,861; 2,501,731; 2,501,732; 2,585,520; 2,671,758; 2,616,904; 2,616,905; 2,616,906; 2,616,911; 2,616,924; 2,616,925; 2,617,049; 2,695,910; 3,178,368; 3,367,867; 3,496,105; 3,629,109; 3,865,737; 3,907,691; 4,100,085; 4,129,589; 4,137,184; 4,184,740; 4,212,752; 4,617,135; 4,647,387; and 4,880,550.

In embodiments of the present disclosure, an overbased detergent having a Total Base Number ("TBN") ranging from about 30 to about 600 may be suitably used as component (ii) or in combination with component (ii), and as a further example an overbased calcium detergent having a TBN ranging from about 200 to about 500 may also be suitably used.

Crankcase lubricating oils of the present disclosure may be formulated in an appropriate base oil by the addition of one or more additives to the synergistic additive described above. The additives may be combined with a base oil in the form of an additive package (or concentrate) or, alternatively, may be combined individually with a base oil. The fully formulated crankcase lubricant may exhibit improved performance properties, based on the additives added and their respective proportions.

Crankcase lubricant compositions are used in vehicles containing spark ignition and compression ignition engines. Such engines may be used in automotive applications and may be operated on fuels including, but not limited to, gasoline, diesel, biodiesel, alcohol, compressed natural gas, and the like. The disclosure is directed specifically to crankcase lubricants, and more particularly to automotive crankcase lubricants that pass a IIIG engine test. Such lubricants may require an increase in friction modifiers and a decrease in metal containing anti-wear agents. The friction modifiers may be selected from metal containing friction modifiers, metal free friction modifiers, and a combination of metal-containing and metal-free friction modifiers. The antiwear agents may be selected from ashless antiwear agents, metal containing antiwear agents, and a combination of ashless and metal containing antiwear agents. Other lubricant ingredients may include one or more dispersants, viscosity modifiers, and/or one or more antioxidants. A particularly suitable lubricant composition may include a base oil of lubricating viscosity, the synergistic additive containing component (i) and (ii) as described above, and a detergent other than component (ii).

In terms of components (i) and (ii), a lubricant composition may contain a weight ratio of (i) to (ii) in ranging from about 0.1:1 to about 12:1. Other suitable weight ratio amounts of component (i) to component (ii) may range from about 1:1 to about 6:1. Still other suitable weight ratio amounts of component (i) to component (ii) may range from about 2:1 to about 3:1. A particularly suitable weight ratio amount of component (i) to component (ii) may range from 2.2:1 to about 2.6:1.

Base Oil

Base oils suitable for use in formulating crankcase lubricant compositions may be selected from any of suitable synthetic or natural oils or mixtures thereof. Natural oils may include animal oils and vegetable oils (e.g., castor oil, lard oil) as well as mineral lubricating oils such as liquid petroleum oils and solvent treated or acid-treated mineral lubricating oils of the paraffinic, naphthenic or mixed paraffinic-naphthenic types. Oils derived from coal or shale may also be suitable. The base oil typically may have a viscosity of about 2 to about 15 cSt or, as a further example, about 2 to about 10 cSt at 100° C. Further, an oil derived from a gas-to-liquid process is also suitable.

Suitable synthetic base oils may include alkyl esters of dicarboxylic acids, polyglycols and alcohols, poly-alpha-olefins, including polybutenes, alkyl benzenes, organic esters of phosphoric acids, and polysilicone oils. Synthetic oils include hydrocarbon oils such as polymerized and interpolymerized olefins (e.g., polybutylenes, polypropylenes, propylene isobutylene copolymers, etc.); poly(1-hexenes), poly-(1-octenes), poly(1-decenes), etc. and mixtures thereof; alkylbenzenes (e.g., dodecylbenzenes, tetradecylbenzenes, di-nonylbenzenes, di-(2-ethylhexyl)benzenes, etc.); polyphenyls (e.g., biphenyls, terphenyl, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic oils that may be used. Such oils are exemplified by the oils prepared through polymerization of ethylene oxide or propylene oxide, the alkyl and aryl ethers of these polyoxyalkylene polymers (e.g., methyl-polyisopropylene glycol ether having an average molecular weight of about 1000, diphenyl ether of polyethylene glycol having a molecular weight of about 500-1000, diethyl ether of polypropylene glycol having a molecular weight of about 1000-1500, etc.) or mono- and polycarboxylic esters thereof, for example, the acetic acid esters, mixed $C_3$-$C_8$ fatty acid esters, or the $C_{13}$ oxo-acid diester of tetraethylene glycol.

Another class of synthetic oils that may be used includes the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Hence, the base oil used which may be used to make the crankcase lubricant compositions as described herein may be selected from any of the base oils in Groups I-V as specified in the American Petroleum Institute (API) Base Oil Interchangeability Guidelines. Such base oil groups are as follows:

TABLE 1

| Base Oil Group[1] | Sulfur (wt %) | | Saturates (wt %) | Viscosity Index |
|---|---|---|---|---|
| Group I | >0.03 | And/or | <90 | 80 to 120 |
| Group II | ≤0.03 | And | ≥90 | 80 to 120 |
| Group III | ≤0.03 | And | ≥90 | ≥120 |
| Group IV | all polyalphaolefins (PAOs) | | | |
| Group V | all others not included in Groups I-IV | | | |

[1]Groups I-III are mineral oil base stocks.

The base oil may contain a minor or major amount of a poly-alpha-olefin (PAO). Typically, the poly-alpha-olefins are derived from monomers having from about 4 to about 30, or from about 4 to about 20, or from about 6 to about 16 carbon atoms. Examples of useful PAOs include those derived from octene, decene, mixtures thereof, and the like. PAOs may have a viscosity of from about 2 to about 15, or from about 3 to about 12, or from about 4 to about 8 cSt at 100° C. Examples of PAOs include 4 cSt at 100° C. poly-alpha-olefins, 6 cSt at 100° C. poly-alpha-olefins, and mixtures thereof. Mixtures of mineral oil with the foregoing poly-alpha-olefins may be used.

The base oil may be an oil derived from Fischer-Tropsch synthesized hydrocarbons. Fischer-Tropsch synthesized hydrocarbons are made from synthesis gas containing $H_2$ and CO using a Fischer-Tropsch catalyst. Such hydrocarbons typically require further processing in order to be useful as the base oil. For example, the hydrocarbons may be hydroisomerized using processes disclosed in U.S. Pat. No. 6,103,099 or 6,180,575; hydrocracked and hydroisomerized using processes disclosed in U.S. Pat. No. 4,943,672 or 6,096,940; dewaxed using processes disclosed in U.S. Pat. No. 5,882,505; or hydroisomerized and dewaxed using processes disclosed in U.S. Pat. Nos. 6,013,171; 6,080,301; or 6,165,949.

Unrefined, refined, and rerefined oils, either natural or synthetic (as well as mixtures of two or more of any of these) of the type disclosed hereinabove can be used in the base oils. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives, contaminants, and oil breakdown products.

The base oil may be combined with an additive composition as disclosed in embodiments herein to provide a crankcase lubricant composition. Accordingly, the base oil may be present in the crankcase lubricant composition in an amount ranging from about 50 wt % to about 95 wt % based on a total weight of the lubricant composition Friction Modifiers Embodiments of the present disclosure may include one or more friction modifiers. Suitable friction modifiers may comprise metal containing and metal-free friction modifiers and may include, but are not limited to, imidazolines, amides, amines, succinimides, alkoxylated amines, alkoxylated ether amines, amine oxides, amidoamines, nitriles, betaines, quaternary amines, imines, amine salts, amino guanadine, alkanolamides, phosphonates, metal-containing compounds, glycerol esters, and the like.

Suitable friction modifiers may contain hydrocarbyl groups that are selected from straight chain, branched chain, or aromatic hydrocarbyl groups or admixtures thereof, and may be saturated or unsaturated. The hydrocarbyl groups may be composed of carbon and hydrogen or hetero atoms such as sulfur or oxygen. The hydrocarbyl groups may range from about 12 to about 25 carbon atoms and may be saturated or unsaturated.

Aminic friction modifiers may include amides of polyamines. Such compounds can have hydrocarbyl groups that are linear, either saturated or unsaturated, or a mixture thereof and may contain from about 12 to about 25 carbon atoms.

Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291, herein incorporated by reference.

Other suitable friction modifiers may include an organic, ashless (metal-free), nitrogen-free organic friction modifier. Such friction modifiers may include esters formed by reacting carboxylic acids and anhydrides with alkanols. Other useful friction modifiers generally include a polar terminal group (e.g. carboxyl or hydroxyl) covalently bonded to an oleophilic hydrocarbon chain. Esters of carboxylic acids and anhydrides with alkanols are described in U.S. Pat. No. 4,702,850. Another example of an organic ashless nitrogen-free friction modifier is known generally as glycerol monooleate (GMO) which may contain mono- and diesters of oleic acid. Other suitable friction modifiers are described in U.S. Pat. No. 6,723,685, herein incorporated by reference. The ashless friction modifier may be present in the lubricant composition in an amount ranging from about 0.1 to about 0.4 percent by weight based on a total weight of the lubricant composition.

Suitable friction modifiers may also include one or more molybdenum compounds. The molybdenum compound may be selected from the group consisting of molybdenum dithiocarbamates (MoDTC), molybdenum dithiophosphates, molybdenum dithiophosphinates, molybdenum xanthates, molybdenum thioxanthates, molybdenum sulfides, a trinuclear organo-molybdenum compound, molybdenum/amine complexes, and mixtures thereof.

Additionally, the molybdenum compound may be an acidic molybdenum compound. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds. Alternatively, the compositions can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/06897.

Suitable molybdenum dithiocarbamates may be represented by the formula:

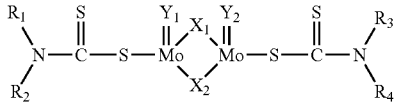

where $R_1$, $R_2$, $R_3$, and $R_4$ each independently represent a hydrogen atom, a $C_1$ to $C_{20}$ alkyl group, a $C_6$ to $C_{20}$ cycloalkyl, aryl, alkylaryl, or aralkyl group, or a $C_3$ to $C_{20}$ hydrocarbyl group containing an ester, ether, alcohol, or carboxyl group; and $X_1$, $X_2$, $Y_1$, and $Y_2$ each independently represent a sulfur or oxygen atom.

Examples of suitable groups for each of $R_1$, $R_2$, $R_3$, and $R_4$ include 2-ethylhexyl, nonylphenyl, methyl, ethyl, n-propyl, iso-propyl, n-butyl, t-butyl, n-hexyl, n-octyl, nonyl, decyl, dodecyl, tridecyl, lauryl, oleyl, linoleyl, cyclohexyl and phenylmethyl. $R_1$ to $R_4$ may each have $C_6$ to $C_{18}$ alkyl groups. $X_1$ and $X_2$ may be the same, and $Y_1$ and $Y_2$ may be the same. $X_1$ and $X_2$ may both comprise sulfur atoms, and $Y_1$ and $Y_2$ may both comprise oxygen atoms.

Further examples of molybdenum dithiocarbamates include $C_6$-$C_{18}$ dialkyl or diaryldithiocarbamates, or alkylaryldithiocarbamates such as dibutyl-, diamyl-di-(2-ethylhexyl)-, dilauryl-, dioleyl-, and dicyclohexyl-dithiocarbamate.

Another class of suitable organo-molybdenum compounds are trinuclear molybdenum compounds, such as those of the formula $Mo_3S_kL_nQ_z$ and mixtures thereof, wherein L represents independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms may be present among all the ligands' organo groups, such as at least 25, at least 30, or at least 35 carbon atoms. Additional suitable molybdenum compounds are described in U.S. Pat. No. 6,723,685, herein incorporated by reference.

The molybdenum compound may be present in a fully formulated crankcase lubricant in an amount to provide about 5 ppm to 200 ppm molybdenum. As a further example, the molybdenum compound may be present in an amount to provide about 50 to 100 ppm molybdenum.

Anti-Foam Agents

In some embodiments, a foam inhibitor may form another component suitable for use in the compositions. Foam inhibitors may be selected from silicones, polyacrylates, and the like. The amount of antifoam agent in the crankcase lubricant formulations described herein may range from about 0.001 wt % to about 0.1 wt % based on the total weight of the formulation. As a further example, antifoam agent may be present in an amount from about 0.004 wt % to about 0.008 wt %.

Dispersant Components

Dispersants contained in the lubricant composition may include, but are not limited to, an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. Dispersants may be selected from Mannich dispersants as described in U.S. Pat. Nos. 3,697,574 and 3,736,357; ashless succinimide dispersants as described in U.S. Pat. Nos. 4,234,435 and 4,636,322; amine dispersants as described in U.S. Pat. Nos. 3,219,666, 3,565,804, and 5,633,326; Koch dispersants as described in U.S. Pat. Nos. 5,936,041, 5,643,859, and 5,627,259, and polyalkylene succinimide dispersants as described in U.S. Pat. Nos. 5,851,965; 5,853,434; and 5,792,729.

Oxidation Inhibitor Components

Oxidation inhibitors or antioxidants reduce the tendency of base stocks to deteriorate in service which deterioration can be evidenced by the products of oxidation such as sludge and varnish-like deposits that deposit on metal surfaces and by viscosity growth of the finished lubricant. Such oxidation inhibitors include hindered phenols, sulfurized hindered phenols, alkaline earth metal salts of alkylphenolthioesters having $C_5$ to $C_{12}$ alkyl side chains, sulfurized alkylphenols, metal salts of either sulfurized or nonsulfurized alkylphenols, for example calcium nonylphenol sulfide, ashless oil soluble phenates and sulfurized phenates, phosphosulfurized or sulfurized hydrocarbons, phosphorus esters, metal thiocarbamates, and oil soluble copper compounds as described in U.S. Pat. No. 4,867,890.

Other antioxidants that may be used include sterically hindered phenols and esters thereof, diarylamines, alkylated phenothiazines, sulfurized compounds, and ashless dialkyldithiocarbamates. Non-limiting examples of sterically hindered phenols include, but are not limited to, 2,6-di-tertiary butylphenol, 2,6 di-tertiary butyl methylphenol, 4-ethyl-2,6-di-tertiary butylphenol, 4-propyl-2,6-di-tertiary butylphenol, 4-butyl-2,6-di-tertiary butylphenol, 4-pentyl-2,6-di-tertiary butylphenol, 4-hexyl-2,6-di-tertiary butylphenol, 4-heptyl-2,6-di-tertiary butylphenol, 4-(2-ethylhexyl)-2,6-di-tertiary butylphenol, 4-octyl-2,6-di-tertiary butylphenol, 4-nonyl-2,6-di-tertiary butylphenol, 4-decyl-2,6-di-tertiary butylphenol, 4-undecyl-2,6-di-tertiary butylphenol, 4-dodecyl-2,6-di-tertiary butylphenol, methylene bridged sterically hindered phenols including but not limited to 4,4-methylenebis(6-tert-butyl-o-cresol), 4,4-methylenebis(2-tert-amyl-o-cresol), 2,2-methylenebis(4-methyl-6 tert-butylphenol, 4,4-methylene-bis(2,6-di-tert-butylphenol) and mixtures thereof as described in U.S. Publication No. 2004/0266630.

Diarylamine antioxidants include, but are not limited to diarylamines having the formula:

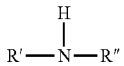

wherein R' and R" each independently represents a substituted or unsubstituted aryl group having from 6 to 30 carbon atoms. Illustrative of substituents for the aryl group include aliphatic hydrocarbon groups such as alkyl having from 1 to 30 carbon atoms, hydroxy groups, halogen radicals, carboxylic acid or ester groups, or nitro groups.

The aryl group is preferably substituted or unsubstituted phenyl or naphthyl, particularly wherein one or both of the aryl groups are substituted with at least one alkyl having from 4 to 30 carbon atoms, preferably from 4 to 18 carbon atoms, most preferably from 4 to 9 carbon atoms. It is preferred that one or both aryl groups be substituted, e.g. mono-alkylated diphenylamine, di-alkylated diphenylamine, or mixtures of mono- and di-alkylated diphenylamines.

The diarylamines may be of a structure containing more than one nitrogen atom in the molecule. Thus the diarylamine may contain at least two nitrogen atoms wherein at least one nitrogen atom has two aryl groups attached thereto, e.g. as in the case of various diamines having a secondary nitrogen atom as well as two aryls on one of the nitrogen atoms.

Examples of diarylamines that may be used include, but are not limited to: diphenylamine; various alkylated diphenylamines; 3-hydroxydiphenylamine; N-phenyl-1,2-phenylenediamine; N-phenyl-1,4-phenylenediamine; monobutyldiphenyl-amine; dibutyldiphenylamine; monooctyldiphenylamine; dioctyldiphenylamine; monononyldiphenylamine; dinonyldiphenylamine; monotetradecyldiphenylamine; ditetradecyldiphenylamine, phenyl-alpha-naphthylamine; monooctyl phenyl-alpha-naphthylamine; phenyl-beta-naphthylamine; monoheptyldiphenylamine; diheptyl-diphenylamine; p-oriented styrenated diphenylamine; mixed butyloctyldi-phenylamine; and mixed octylstyryldiphenylamine.

The sulfur containing antioxidants include, but are not limited to, sulfurized olefins that are characterized by the type of olefin used in their production and the final sulfur content of the antioxidant. High molecular weight olefins, i.e. those olefins having an average molecular weight of 168 to 351 g/mole, are preferred. Examples of olefins that may be used include alpha-olefins, isomerized alpha-olefins, branched olefins, cyclic olefins, and combinations of these.

Alpha-olefins include, but are not limited to, any $C_4$ to $C_{25}$ alpha-olefins. Alpha-olefins may be isomerized before the sulfurization reaction or during the sulfurization reaction. Structural and/or conformational isomers of the alpha olefin that contain internal double bonds and/or branching may also be used. For example, isobutylene is a branched olefin counterpart of the alpha-olefin 1-butene.

Sulfur sources that may be used in the sulfurization reaction of olefins include: elemental sulfur, sulfur monochloride, sulfur dichloride, sodium sulfide, sodium polysulfide, and mixtures of these added together or at different stages of the sulfurization process.

Unsaturated oils, because of their unsaturation, may also be sulfurized and used as an antioxidant. Examples of oils or fats that may be used include corn oil, canola oil, cottonseed oil, grapeseed oil, olive oil, palm oil, peanut oil, coconut oil, rapeseed oil, safflower seed oil, sesame seed oil, soyabean oil, sunflower seed oil, tallow, and combinations of these.

The amount of sulfurized olefin or sulfurized fatty oil delivered to the finished lubricant is based on the sulfur content of the sulfurized olefin or fatty oil and the desired level of sulfur to be delivered to the finished lubricant. For example, a sulfurized fatty oil or olefin containing 20 weight % sulfur, when added to the finished lubricant at a 1.0 weight % treat level, will deliver 2000 ppm of sulfur to the finished lubricant. A sulfurized fatty oil or olefin containing 10 weight % sulfur, when added to the finished lubricant at a 1.0 weight % treat level, will deliver 1000 ppm sulfur to the finished lubricant. It is desirable that the sulfurized olefin or sulfurized fatty oil to deliver between 200 ppm and 2000 ppm sulfur to the finished lubricant.

In general terms, a suitable crankcase lubricant may include additive components in the ranges listed in the following table.

TABLE 2

| Component | Wt. % (Broad) | Wt. % (Typical) |
|---|---|---|
| Dispersant | 0.5-10.0 | 1.0-5.0 |
| Antioxidant system | 0-5.0 | 0.01-3.0 |
| Metal Detergents | 0.1-15.0 | 0.2-8.0 |
| Corrosion Inhibitor | 0-5.0 | 0-2.0 |
| Metal dihydrocarbyl dithiophosphate | 0.1-6.0 | 0.1-4.0 |
| Ash-free amine phosphate salt | 0.0-6.0 | 0.0-4.0 |
| Antifoaming agent | 0-5.0 | 0.001-0.15 |
| Supplemental antiwear agents | 0-1.0 | 0-0.8 |
| Pour point depressant | 0.01-5.0 | 0.01-1.5 |
| Viscosity modifier | 0.01-20.00 | 0.25-10.0 |
| Supplemental friction modifier | 0-2.0 | 0.1-1.0 |
| Base oil | Balance | Balance |
| Total | 100 | 100 |

Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent). The use of an additive concentrate may take advantage of the mutual compatibility afforded by the combination of ingredients when in the form of an additive concentrate. Also, the use of a concentrate may reduce blending time and may lessen the possibility of blending errors.

The present disclosure provides novel lubricating oil blends specifically formulated for use as automotive crankcase lubricants. Embodiments of the present disclosure may provide lubricating oils suitable for crankcase applications and having improvements in the following characteristics: antioxidancy, antiwear performance, rust inhibition, fuel economy, water tolerance, air entrainment, and foam reducing properties.

In order to demonstrate the benefits and advantages of lubricant compositions according to the disclosure, the following non-limiting examples are provided.

EXAMPLES

Three fully formulated lubricant compositions were prepared using a Group II base oil. Formulation A included 0.98 wt. % zinc dialkyldithiophosphate, of which 0.34 wt. % was derived from 100 mole percent 2-ethylhexyl groups and about 0.64 wt. % was derived from 100 mole percent 4-methyl-2-pentyl groups. The detergent was a mixture of 1.8 wt. % overbased calcium sulfonate and 0.4 wt. % of a 153 TBN alkylphenate based on a total weight of the lubricant composition. Formulation B included 0.92 wt. % of a zinc dialkyldithiophosphate that contained about 100 mole percent 4-methyl-2-pentyl groups as the alkyl groups. The detergent mixture was the same as in Formulation A. Formulation C included 0.91 wt. % of a zinc dialkyldithiophosphate that contained about 100 mole percent 4-methyl-2-pentyl groups as the alkyl groups and the detergent was 1.8 wt. % overbased calcium sulfonate and no phenate detergent. All of the formulations had a TBN ranging from about 7.0 to 7.7. A IIIG engine test was run on all three formulations. The results are shown in the following table.

TABLE 3

| IIIG Engine Test | Formulation A | Formulation B | Formulation C |
|---|---|---|---|
| Viscosity increase (150% max) | 268 | 131 | 324 |
| Weighted piston deposits (3.5 min) | 4.3 | 4.1 | 3.3 |
| After cam-plus-lifter wear (60 μm max) | 19 | 15 | 23 |
| Stuck rings (none) | None | None | None |
| Hot oil consumption (4.65 L max) | 4.34 | 3.87 | 4.5 |
| Results | Fail | Pass | Fail |

As shown by the foregoing example, Formulation B containing a metal dialkyldithiophosphate derived from 100 mole % 4-methyl-2-pentanol and a detergent mixture containing a phenate detergent provided a passing grade in a IIIG engine test with a Group II base oil. Formulation A that had the same detergent mixture as Formulation B but a different dialkyldithiophosphate failed the IIIG test. Likewise, Formulation C that had the same dialkyldithiophosphate as Formulation B but no phenate detergent in the detergent mixture also failed the IIIG engine test.

At numerous places throughout this specification, reference has been made to a number of U.S. Patents. All such cited documents are expressly incorporated in full into this disclosure as if fully set forth herein.

Other embodiments of the present disclosure will be apparent to those skilled in the art from consideration of the specification and practice of the embodiments disclosed herein. As used throughout the specification and claims, "a" and/or "an" may refer to one or more than one. Unless otherwise indicated, all numbers expressing quantities of ingredients, properties such as molecular weight, percent, ratio, reaction conditions, and so forth used in the specification and claims are to be understood as being modified in all instances by the term "about." Accordingly, unless indicated to the contrary, the numerical parameters set forth in the specification and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. It is intended that the specification and examples be considered as exemplary only, with a true scope and spirit of the invention being indicated by the following claims.

The foregoing embodiments are susceptible to considerable variation in practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

What is claimed is:

1. A lubricant composition for lubricating a spark ignition engine comprising:

from 50 wt. % to 95 wt. % of a Group II base oil of lubricating viscosity based on a total weight of the lubricant composition, one or more zinc dialkyldithiophosphates having more than 75 mole percent of alkyl groups derived from 4-methyl-2-pentanol; and from about 0.1 to 1.0 percent by weight of a first metal-containing detergent derived from an alkyl phenol or sulfurized alkyl phenol based on a total weight of the lubricant composition, wherein the lubricant composition comprises an amount of the one or more zinc dialkyldithiophosphates to provide from about 0.01 to about 0.10 percent by weight phosphorus based on a total weight of the lubricant composition, and wherein the lubricant composition has a total a total base number (TBN) of 6.5 to 10.0.

2. The lubricant composition of claim 1, wherein the one or more zinc dialkyldithiophosphates have 100 mole percent of the alkyl groups derived from 4-methyl-2-pentanol.

3. The lubricant composition of claim 1, further comprising an overbased alkali or alkaline earth metal second detergent in an amount ranging from 0.2 to 2.0 weight percent based on a total weight of the lubricant composition, wherein the second detergent is not derived from an alkyl phenol or sulfurized alkyl phenol.

4. The lubricant composition of claim 1, wherein the lubricant composition comprises from about 0.3 to about 0.6 percent by weight of the first detergent derived from the alkyl phenol or sulfurized alkyl phenol based on a total weight of the lubricant composition.

5. A method for reducing engine deposits as determined by a IIIG engine test comprising:

formulating a lubricant composition comprising from 50 wt. % to 95 wt. % of a Group II base oil of lubricating viscosity based on a total weight of the lubricant composition, and an effective amount of synergistic additive comprising (i) one or more zinc dialkyldithiophosphates having more than 75 mole percent of alkyl groups derived from 4-methyl-2-pentanol, and (ii) from about 0.1 to 1.0 weight percent of a first metal-containing detergent derived from an alkyl phenol or sulfurized alkyl phenol, based on a total weight of the lubricant composition, wherein the lubricant composition has a total a total base number (TBN) of 6.5 to 10.0, and wherein the effective amount is an amount sufficient to pass a IIIG engine test; and operating an engine on the lubricant composition.

6. The method of claim 5, wherein the engine comprises an internal combustion engine.

7. The method of claim 5, wherein the one or more zinc dialkyldithiophosphates have 100 mole percent of the alkyl groups derived from 4-methyl-2-pentanol.

8. The method of claim 5, wherein the one or more zinc dialkyldithiophosphates are present in the lubricant composition in an amount to provide from about 0.01 to about 0.10 percent by weight phosphorus based on a total weight of the lubricant composition.

9. The method of claim 5, wherein the lubricant composition comprises from about 0.3 to about 0.6 percent by weight of the first metal-containing detergent derived from the alkyl phenol or sulfurized alkyl phenol based on a total weight of the lubricant composition.

10. A synergistic additive package for a lubricating oil composition comprising:

(i) one or more zinc dialkyldithiophosphates having more than 75 mole percent of alkyl groups derived from 4-methyl-2-pentanol in an amount sufficient to provide 0.01 to about 0.1 percent by weight phosphorus to a fully formulated lubricant composition; and (ii) a metal-containing detergent derived from an alkyl phenol or sulfurized alkyl phenol, wherein a weight ratio of (i) to (ii) in the additive package ranges from 0.1:1 to 12:1;

(iii) an overbased alkali or alkaline earth metal sulfonate detergent in an amount sufficient to provide from about 0.2 to about 2.0 weight percent of overbased alkali or alkaline earth metal sulfonate to a fully formulated lubricant composition, based on a total weight of the fully formulated lubricant composition, wherein the amount of overbased sulfonate detergent is sufficient to provide the fully formulated lubricant composition with a total base number (TBN) of 6.5 to 8.5.

11. The additive package of claim 10, wherein the one or more zinc dialkyldithiophosphates have 100 mole percent of alkyl groups derived from 4-methy-2-pentanol.

12. The additive package of claim 10, wherein a weight ratio of (i) to (ii) in the additive package ranges from about 2.0:1 to about 3:1.

* * * * *